United States Patent [19]

Pai

[11] 4,105,495

[45] Aug. 8, 1978

[54] STRETCH-RESISTANT PAPERMAKERS BELTS HAVING NON-POROUS SYNTHETIC CABLES

[75] Inventor: Karnire S. Pai, Greeneville, Tenn.

[73] Assignee: Huyck Corporation, Wake Forest, N.C.

[21] Appl. No.: 638,391

[22] Filed: Dec. 8, 1975

[51] Int. Cl.[2] ..... D21F 1/10; D03D 15/00

[52] U.S. Cl. ..... 162/348; 139/383 A; 139/422; 139/425 A; 162/DIG. 1; 428/259; 428/395; 428/401

[58] Field of Search ..... 162/289, 348, 358, DIG. 1; 139/383 A, 426 R, 421, 422, 425 A; 34/95; 428/226, 229, 231, 258, 259, 280, 395, 401

[56] References Cited

U.S. PATENT DOCUMENTS

| | | | |
|---|---|---|---|
| 2,903,021 | 9/1959 | Holden et al. | 139/425 A |
| 2,992,681 | 7/1961 | Hornbustel et al. | 162/348 |
| 3,000,076 | 9/1961 | Runton et al. | 428/229 X |
| 3,158,984 | 12/1964 | Butler | 162/DIG. 1 |
| 3,248,802 | 5/1966 | Wagner | 34/95 |
| 3,252,484 | 5/1966 | Meyer et al. | 428/258 X |
| 3,915,202 | 10/1975 | Curtis et al. | 139/425 A |

FOREIGN PATENT DOCUMENTS 2,111,320 5/1973 Fed. Rep. of Germany.

OTHER PUBLICATIONS

"1975 Man-made Fiber Deskbook", Modern Textiles Magazine, Mar. 1975, pp. 17, 26.

*Primary Examiner*—Richard V. Fisher
*Attorney, Agent, or Firm*—Sanford S. Wadler

[57] ABSTRACT

This invention relates to conveyor belt-like papermakers' fabrics for use in papermaking machines which comprise non-porous cables comprised of a plurality of yarns. Each yarn comprises at least two twisted monofilaments which are substantially circular in cross-sectional configuration.

5 Claims, 6 Drawing Figures

STRETCH-RESISTANT PAPERMAKERS BELTS HAVING NON-POROUS SYNTHETIC CABLES

BACKGROUND OF THE INVENTION

In the past, certain papermakers' belts or fabrics have been described as being manufactured from porous cables comprising a plurality of monofilaments which are non-circular in cross-sectional configuration.In this connection, reference is made to Butler, U.S. Pat. No. 3,158,984. However, it is believed that such cabled structures would have several disadvantages which the present invention attempts to solve. For example, it is believed that such prior art structures would tend to stretch due to the void space encountered in the interstices of the cables making up the machine or longitudinal direction yarns of the fabric which interstices result from using such non-circular monofilaments. By machine or longitudinal direction yarns it is meant those yarns which extend in the direction of travel of such conveyor belt-like fabrics. In addition, it is believed that such structures would be subject to fill-up with pulp particles or fines or fillers in the interstices of the porous cables, thus causing the papermakers' belt to drain in a non-uniform manner. Further, due to the likelihood of pulp fines and fibers entangling and building up in the interstices present in the porous cables of such structures, it is believed that such belts would exhibit poor sheet release. By sheet release, it is meant the situation wherein the paper sheet is transferred from one section of a papermaking machine to another.

In the field of papermaker's fabrics it has also been known to make and use fabrics woven from traditional multifilament yarns which characteristically comprise a plurality of groups of twisted fibers or filaments. However, it is believed that in some papermaking applications such prior art fabrics have less dimensional stability in the cross-machine direction, and less desirable surface properties with regard to paper web formation, relative to the fabrics of the present invention. It is presently believed that these problems result from the structure of such prior art fabrics utilizing multifilament yarns made from fibers or filaments each of which has a cross-sectional diameter of 1.7 mils or less. While not wishing to be bound by any specific theory, it is thought that the constituents of the fibrous material in a multifilament yarn has a tendency to slide over one another, as for example, when tension is applied to the fabric. This sliding then causes the fabric to distort from the required shape causing sleasiness as well as other undesirable characteristics.

It is believed that it is possible to overcome the forementioned problems by utilizing a papermakers' belt which comprises yarns formed from circular monofilaments by which is meant monofilaments which are circular in cross-sectional configuration. Such yarns are plied or cabled such that essentially non-porous cables are formed. Without wishing to be bound by any particular theory, it is thought that by making a papermakers' belt having such non-porous cables it is possible to have a cabled structure with substantially no void space in the cables; hence reducing stretch when the belt is put on the drive rolls of a papermaking machine. It is also believed that by constructing a papermakers' belt utilizing monofilaments it is possible to overcome the sleasiness associated with prior are multifilament papermakers' belts. In addition, it is believed that the lack of avoids within the cabled structure of the belt of the present invention will prevent plug-up by pulp fines and fillers which might cause an irregular drainage surface or problems with regard to sheet release.

In addition to overcoming the forementioned problems, it is believed that papermakers' belts made in accordance with the teachings of the present invention provide a number of other advantages. For example, since such cabled yarns have a relatively high modulus of elasticity in addition to being non-porous, when they are used in the load bearing direction of a papermaker's belt it is possible to produce a belt having substantial stretch resistance. It is believed that this allows for the production of belts having low drag characteristics and therefore better wear characteristics, as well as an increase in the overall efficiency of the papermaking operation. The term drag as used herein is meant to refer to the frictional interaction between the papermakers' belt and the surfaces of the papermachine components. Further, by weaving with such cabled structures as in the present invention, it is possible, if desired, to increase the number of cross-machine direction strands or cables per inch without reducing the number of machine direction cables per inch unless such a reduction is desired. By so increasing the number of cross-machine direction strands or cables per inch it is possible, if desirable, to produce a fabric having square interstices without having to reduce the number of machine direction cables per inch to effect such a result. Unexpectedly, it has been found that such fabrics have excellent pulp fine retention properties as well as superior cross machine direction stability and shove resistance. By shove resistance it is meant the ability of adjacent yarns or cables to maintain their position relative to one another when lateral forces act on their side walls. It is thought that the improved fine retention properties results from the use of a fabric having square interstices.

Without wishing to be bound by any particular theory, it is believed that a greater number of cross machine direction strands or cables can be included in fabrics as described above because prior to finishing the machine direction cables of the present invention have a relatively high degree of deformability, thus allowing more cross machine direction strands or cables to be inserted for a given unit of belt width. Hence, using such cables not only allows for the introduction of a greater number of cross machine direction strands or cables in the fabric but also enables the manufacturing of such fabrics at lower loom loads than would otherwise be possible without the use of such cables. It is thought that lower loom loads can be utilized because such cables are easily deformable before finishing and hence give less resistance to forces exerted during weaving.

Thus, it is an object of the present invention to provide a papermaker's belt in which non-porous cables extend in the machine direction and are comprised of yarns formed from monofilaments which are circular in cross-sectional configuration.

It is a further object of this invention to provide a papermakers' belt having improved stretch resistance in comparison to prior art papermaker's fabrics.

Another object of the present invention is to provide a papermakers' belt which provides for improved retention of pulp fines.

A still other object of this invention is to provide a means of increasing the number of cross machine direction strands or cables per inch in a papermakers' fabric without reducing the number of machine direction cables per inch while utilizing low loom loads.

A further object of the present invention is to provide a papermakers' belt having improved dimensional stability and shove resistance.

A still further object of the present invention is to provide a papermakers' belt having improved drainage uniformity.

Another object of the present invention is to provide a papermakers' belt having improved sheet release properties.

Yet, another object of the present invention is to provide a papermakers' belt having reduced pulp fine and filler build-up in the cables comprising the belt.

SUMMARY OF THE INVENTION

These and other objects as will be apparent to those individuals who are skilled in the art can be achieved from the practice of the present invention in one embodiment of which a papermakers fabric comprises non-porous synthetic cables which extend in the longitudinal direction of such fabric. Each of the cables comprise at least three yarns and each of such yarns comprise two or more monofilaments which are circular in cross section and have a diameter of at least 3 mils.

An understanding of this invention may be had from the detailed discussion which will follow and from an examination of the drawings included herein which.

DESCRIPTION OF THE PREFERRED EMBODIMENTS

Figure 1:
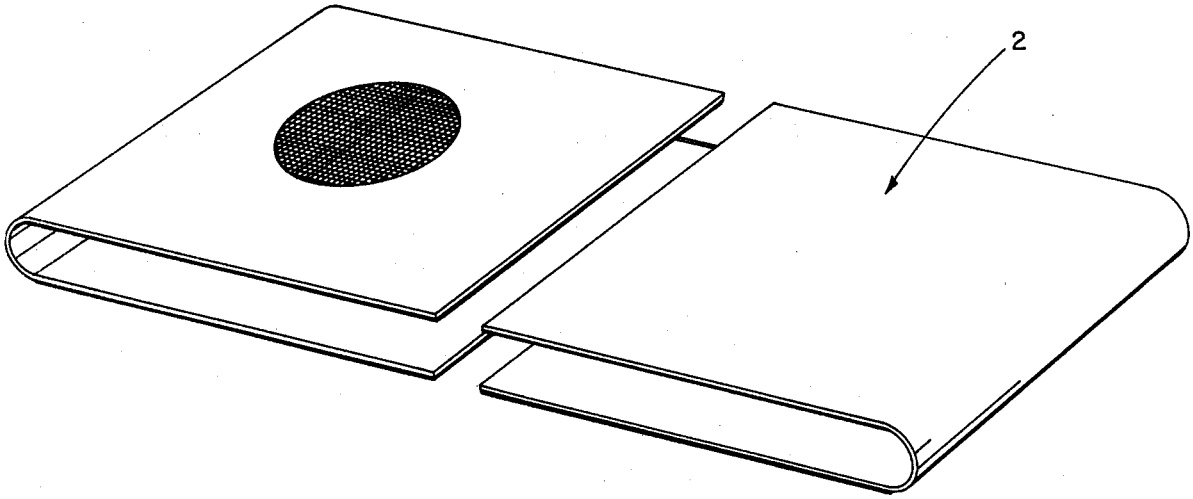
FIG. 1 is a perspective view of a papermakers' belt embodying the present invention.
Figure 2:
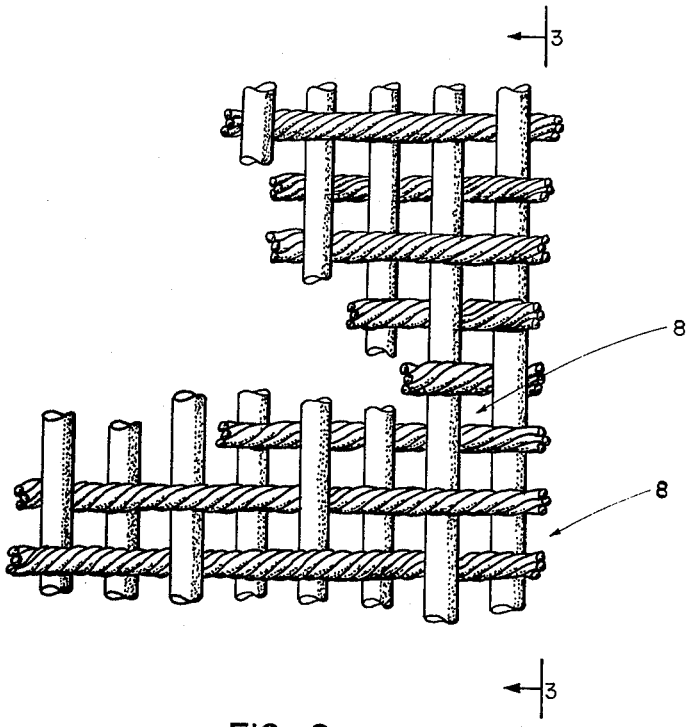
FIG. 2 is a fragmentary plan view of a portion of the papermakers' belt shown in FIG. 1.

Referring now to FIGS. 2 through 5, which are views of a portion of the papermakers' belt 2 shown in FIG. 1, non-porous cables 8 extend in the machine direction and comprise yarns 2, 4, 6 which have been plied or cabled together. Yarns 2, 4, 6 each comprise substantially circular monofilaments which have been twisted together. By the forementioned use of the term cable it is meant a structure which is made up of plied yarns. A plied yarn is taken for present purposes to mean a yarn formed by twisting together two or more monofilaments. Generally, the term monofilament as used herein is meant to refer to a single filament made from man-made fibers such as polyamide, acetate, rayon, polyester, orlon, fiberglass and the like, which is circular in cross section and has a diameter of at least three mils. The forementioned cables of the present invention extend in the machine direction and may also be used in the cross machine or transverse direction as well if desired although any type of yarn or strand suitable for use in papermakers fabrics may be used in the transverse direction. For example, it has been found that polyester monofilaments are particularly useful in the transverse direction. It should be understood that the term papermakers' belt as used herein includes forming fabrics, dryer fabrics and felts, and the like, and is meant to include such fabrics and felts as may be endless woven or woven flat and then joined so as to form a conveyor belt-like structure. Any monofilaments may be used to form the yarns which comprise the cables of the present invention and the recitation of monofilaments made from a specific material is not meant to limit the scope or range of the present invention.

Figure 5A:
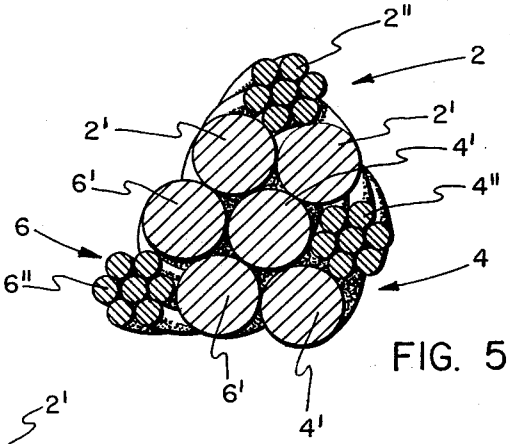
FIG. 5A is a cross-sectional view of a cable of the present invention comprising ultra high modulus strands.

If it is desirable to further increase the stretch resistance of papermakers fabrics of the present invention, other strands or strand-like material can be used in combination with the cables described herein. In addition to ordinary strands, stretch resistance can be increased by including ultra high modulus strands in combination with the cables of the present invention. For example, if it is desired to produce cables having a very high initial modulus and a consequent low elongation, the cables of the present invention can be combined with synthetic multifilament fibers such as -poly (para-phenylene terephthalamide) and is sold under the trademarks Kevlar and Kevlar 29 and manufactured by E. I. Du Pont De Nemours & Company. In one embodiment as depicted in FIG. 5A and described below, such multifilament fibers may be twisted with the monofilaments comprising the individual yarns which make up the cabled structure so long as each yarn contains at least two monofilaments. However, any suitable manner may be utilized in combining additional strands with the yarns which make up the cables of the present invention.

Figure 4:
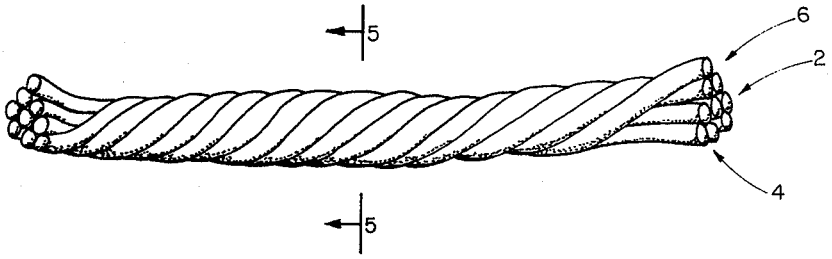
FIG. 4 is an enlarged fragmentary view showing one form of a cable of the present invention.
Figure 3:
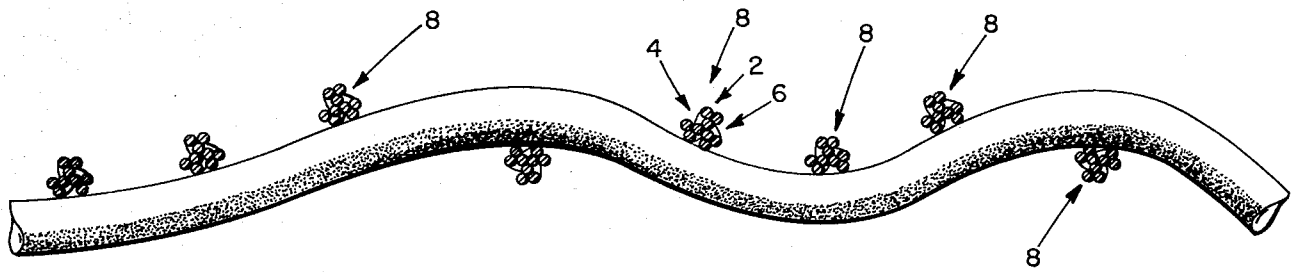
FIG. 3 is a sectional view along line 3—3 in FIG. 2.
Figure 5:
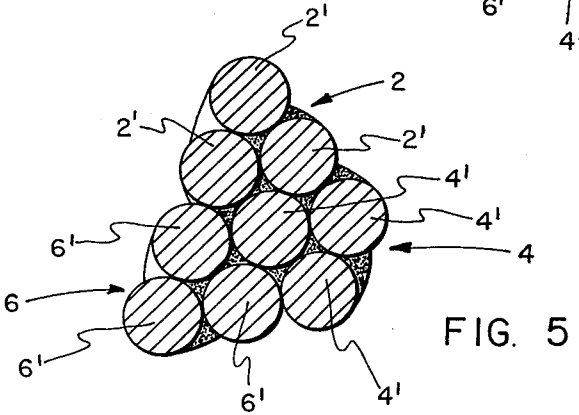
FIG. 5 is a cross-sectional view taken along lines 5—5 of FIG. 4.

In the preferred embodiment depicted in FIGS. 2 through 5 of the drawings, cables 8 are made up of a plurality of yarns 2, 4, 6 which have been plied together. Each cable 8 can be achieved as shown in the drawings by plying a plurality of yarns 2, 4, 6 each one of which comprises two or more polyester monofilaments which are substantially circular in cross section and which have been twisted together. For example, yarn 2 preferably comprises synthetic monofilaments 2', such as polyester monofilaments, which are circular in cross section and which are twisted together. Similarly, yarns 4 and 6 comprise such monofilaments 4' and 6', respectively. The yarns 2, 4, 6 can be plied around each other after the constituent monofilaments of each yarn have been twisted together as shown in FIGS. 4 and 5. In a further embodiment the yarns 2, 4, 6 could be plied around a central core yarn (not shown) so as to form the various cable constructions which can be utilized in various embodiments of the present papermakers' belt. In a further embodiment, and as noted above, if it is desired that the cables 8 have an extremely high stretch resistance or other properties achievable by incorporating ultra high modulus strands, then the cables of the present invention could include ultra high modulus multifilaments such as Kevlar. For example, as depicted in FIG. 5A one of the constituent monofilaments 2', 4', 6' in one or more of the yarns 2, 4, 6 could be replaced with multifilament Kevlar 2'', 4'', 6'' or similar material, and the remaining monofilaments would comprise polyester or polyamide or some other suitable material. Alternatively, in the cable depicted in FIG. 5, plied yarn 6 can consist of one type of monofilaments 6' and be plied with yarns 2 and 4 of some other type of monofilaments. Using these methods, it is possible, if desirable, to adjust the modulus of the papermakers' belt so as to be suitable for a variety of end-use applications by selectively varying the types of monofilaments and other strands used in each cable.

In twisting the monofilaments or other constituents which comprise the plied yarns, any of the common twist configurations such as S or Z can be used and the recitations of these specific configurations are not meant to exclude or preclude others. In plying the yarns which make up the cable the only requirement is that it be plied or cabled in a direction opposite to that used in twisting the monofilaments which make up the yarn. For example if the monofilaments have been subjected to an S twist it will be necessary for the yarn to be plied with a Z twist, the choice of twisting and plying or cabling being mainly dependent on the intended end use of the present invention.

If desired, fabric stability can be increased by resin treating the cables usd in the production of the fabric. In addition, if desired any additional strands or strand-like materials used can also be resin treated.

By way of examples, and without intending to limit the scope of suitable resins which might be used in the present inventions, such resins as nylon resins, water-based acrylics in which two examples are Rhoplex AC-201 (produced by ROHM & HASS) and Hycar 2600 × 172 (produced by B. F. Goodrich), phenolyic resins and amino resins such as American Cyanamids Aerotex M-3 are suitable for use in practicing the present invention.

The above-mentioned resins have the following chemical and physical identification:

| | |
|---|---|
| Rhoplex ® AC 201 (Rohm and Haas Co.) | |
| Thermosetting Acrylic Emulsion | |
| Solids Content | 46 ± 1% |
| pH | 9.0 to 10.0 |
| Emulsifying System | Nonionic |
| Approximate Viscosity as packed, cps (#2 spindle, 60 rpm at 25° C, Brookfield LVF Viscometer) | 60 |
| Minimum Film Forming Temperature, ° C | +29 |
| Aerotex ® M-3 | |
| (American Cyanamid Company) | |
| A melamine-formaldehyde condensate (trimethylol melamine type) | |
| Active Ingredients | 80% |
| pH | 8.5 - 9.0 |
| Solubility | Soluble in water in all proportions |
| lbs./gal. | 10.0 |
| Hycar ® 2600X 172 Acrylic Latex | |
| Water dispersion of modified hard acrylic polymer | |
| Emulsifying System | Anionic |
| Density Latex, lbs./gal. | 8.7 |
| Solids Content | 50% |
| pH | 2.5 |

-continued

| | |
|---|---|
| Viscosity (Brookfield, #2, 60 rpm) | 200 cps |
| Surface Tension (dynes/cm) | 50 |
| Glass Transition Temp. (° C) | +33 |
| Special Gravity | |
| Latex | 1.05 |
| Solids | 1.10 |

One desirable resin coating method might be to use a two step resin treatment, whereby first a thermo-setting acrylic resin is applied and then a phenolic resin. Such a suitable method and apparatus for applying the resin is known to be described in Christie, et al. U.S. Pat. Nos. 3,252,821 and 3,149,003.

It will, of course, be apparent to those skilled in the art that the present invention may be practiced in a wider variety of embodiments than have been set forth in detail at present without having to materially depart from the spirit and scope of the teachings contained herein. It also should be understood that in the foregoing specification, specific embodiments and components of the present invention have been used for illustrative purposes and discussed by way of example and not by way of limitation, and therefore this invention may be practiced by those skilled in the art by utilizing a wide variety of materials and configurations without departing substantially from the true spirit of the present invention.

I claim:

1. A stretch resistant papermakers' fabric for use on a papermaking machine comprising nonporous synthetic cables which extend in the longitudinal direction of said fabric and comprising synthetic yarns which extend in the transverse direction of said fabric and, wherein each of said cables comprise at least three yarns and each of said yarns of said cables comprising two or more monofilaments which are circular in cross section and have a diameter of at least 3 mils and wherein said yarns which comprise said cables comprise monofilaments of polyester and include ultra high modulus multifilaments.

2. A fabric as recited in claim 1 wherein said multifilaments comprise poly (para-phenylene terephthalamide).

3. A fabric as recited in claim 1 wherein said yarns of said cables include multifilament poly (para-phenylene terephthalamide), and said cables are resin coated.

4. A fabric as recited in claim 3 wherein said cables are resin coated with a thermo-setting acrylic resin.

5. A fabric as recited in claim 1 wherein said transverse direction yarns comprise polyester monofilaments.

* * * * *